US009419415B2

(12) United States Patent
Mizuno et al.

(10) Patent No.: US 9,419,415 B2
(45) Date of Patent: Aug. 16, 2016

(54) SPARK PLUG

(71) Applicant: NGK SPARK PLUG CO., LTD., Nagoya-shi, Aichi (JP)

(72) Inventors: Takamitsu Mizuno, Hashima (JP); Satoshi Yano, Konan (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/431,358

(22) PCT Filed: Apr. 18, 2013

(86) PCT No.: PCT/JP2013/002619
§ 371 (c)(1),
(2) Date: Mar. 26, 2015

(87) PCT Pub. No.: WO2014/049905
PCT Pub. Date: Apr. 3, 2014

(65) Prior Publication Data

US 2015/0263490 A1 Sep. 17, 2015

(30) Foreign Application Priority Data

Sep. 27, 2012 (JP) ..... 2012-213321

(51) Int. Cl.
*H01T 13/20* (2006.01)
*H01T 13/40* (2006.01)
(Continued)

(52) U.S. Cl.
CPC ..... *H01T 13/40* (2013.01); *H01T 13/34* (2013.01); *H01T 13/39* (2013.01); *H01T 13/41* (2013.01)

(58) Field of Classification Search
CPC ..... H01T 13/08; H01T 13/41
USPC ..... 313/141, 144
See application file for complete search history.

(56) References Cited

U.S. PATENT DOCUMENTS 6,160,342 A 12/2000 Nishikawa et al. ..... 313/141
6,334,800 B1 1/2002 Nishikawa et al. ..... 445/7
(Continued)

FOREIGN PATENT DOCUMENTS

JP 49-120933 10/1974
JP 56-118288 9/1981 ..... H01T 21/02
(Continued)

OTHER PUBLICATIONS

International Search Report issued in corresponding International Patent Application No. PCT/JP2013/002619, dated Jun. 11, 2013.

*Primary Examiner* — Vip Patel
(74) *Attorney, Agent, or Firm* — Kusner & Jaffe

(57) ABSTRACT

A spark plug includes an insulator with a through hole, a center electrode disposed at a tip end side of the through hole, a metal terminal nut disposed at a rear end side of the through hole, a resistor disposed in a position between the center electrode and the metal terminal nut inside of the through hole and apart from the center electrode, and a conductive seal that is disposed between the resistor and the center electrode inside of the through hole and contacts both the center electrode and the resistor. A contact surface between the resistor and the conductive seal includes at least one point where a distance in the central axis direction from a virtual plane that includes a rear end of the resistor and is vertical to the central axis is local maximum, and include at least one point where the distance is local minimum.

9 Claims, 8 Drawing Sheets

(51) Int. Cl.

| | |
|---|---|
| ***H01T 13/41*** | (2006.01) |
| ***H01T 13/34*** | (2006.01) |
| ***H01T 13/39*** | (2006.01) |

(56) References Cited

U.S. PATENT DOCUMENTS

| | | | | |
|---|---|---|---|---|
| 6,583,537 | B1 | 6/2003 | Honda et al. | 313/136 |
| 2010/0264823 | A1 | 10/2010 | Suzuki et al. | 315/71 |

FOREIGN PATENT DOCUMENTS

| | | | | |
|---|---|---|---|---|
| JP | 58-102481 | | 6/1983 | H01T 13/20 |
| JP | H05152053 | A | 6/1993 | H01T 13/20 |
| JP | 11-214119 | | 8/1999 | H01T 13/20 |
| JP | 11-233232 | | 8/1999 | H01T 13/20 |
| JP | 2006-066086 | A | 3/2006 | H01T 13/20 |
| JP | 2009-245716 | A | 10/2009 | H01T 13/20 |

FIG. 6

(A) EVALUATION RESULT A

| | MINIMUM PENETRATION LENGTH HA (mm) | MINIMUM PROJECTION LENGTH KA (mm) | MAXIMUM PENETRATION LENGTH HD (mm) | MAXIMUM PROJECTION LENGTH KD (mm) | IMPACT RESISTANCE |
|---|---|---|---|---|---|
| #1 | −0.7 | 0.1 | −0.7 | 0.1 | B |
| #2 | −0.5 | 0.3 | 0.0 | 0.8 | B |
| #3 | −0.5 | 0.3 | 0.1 | 0.9 | A |
| #4 | 0.0 | 0.8 | 0.0 | 0.8 | B |
| #5 | 0.0 | 0.8 | 0.1 | 0.9 | A |
| #6 | 0.1 | 0.9 | 0.1 | 0.9 | A |
| #7 | 0.5 | 1.3 | 0.5 | 1.3 | A |
| #8 | 1.1 | 1.9 | 1.1 | 1.9 | A |

(B) EVALUATION RESULT B

| SAMPLE | MINIMUM PENETRATION LENGTH HA (mm) | RADIO-WAVE NOISE REDUCTION PERFORMANCE | LOAD LIFE |
|---|---|---|---|
| #9 | −1.0 | C | A |
| #10 | 0.0 | C | A |
| #11 | 0.1 | B | A |
| #12 | 0.5 | B | B |
| #13 | 0.7 | A | B |
| #14 | 1.1 | A | B |
| #15 | 1.2 | A | B |
| #16 | 1.3 | A | D |

MODIFICATIONS

SPARK PLUG

RELATED APPLICATIONS

This application is a National Stage of International Application No. PCT/JP2013/002619 filed Apr. 18, 2013, which claims the benefit of Japanese Patent Application No. 2012-213321, filed Sep. 27, 2012.

FIELD OF THE INVENTION

The present invention relates to a spark plug that includes a resistor inside of a through hole of an insulator.

BACKGROUND OF THE INVENTION

In order to reduce radio wave noise generated by ignition, a spark plug that includes a resistor inside of a through hole of an insulator is known (for example, see JP-A-2009-245716). In this spark plug, a conductive seal is disposed between the resistor and a center electrode. A contact portion between the resistor and the conductive seal is formed in a bowl shape that projects toward a tip end side around the central axis of the through hole. Consequently, this expands the contact portion between the conductive seal and the resistor compared with the case where the contact portion lies in a horizontal plane. This reduces sealing failure (such as peeling) between the conductive seal and the resistor.

However, in the above-described technique, the resistor has a shorter effective length compared with the case where the contact portion lies in a horizontal plane. This may decrease radio-wave noise reduction performance.

The main advantage of the present invention is a technique that reduces sealing failure between the conductive seal and the resistor while suppressing decrease in radio-wave noise reduction performance.

SUMMARY OF THE INVENTION

The present invention is made to solve at least a part of the above-described problem, and can be realized as the following application examples.

Application Example 1

In accordance with a first aspect of the present invention, there is provided a spark plug that includes an insulator, a center electrode, a metal terminal nut, a resistor, and a conductive seal. The insulator extends along a central axis, and includes a through hole that passes through the insulator along the central axis. The center electrode extends along the central axis, and includes a rear end positioned inside of the through hole. The metal terminal nut extends along the central axis, and includes a tip end positioned at the rear end side with respect to the rear end of the center electrode inside of the through hole. The resistor is disposed in a position between the center electrode and the metal terminal nut inside of the through hole and apart from the center electrode. The conductive seal is disposed between the resistor and the center electrode inside of the through hole, and contacts both the center electrode and the resistor. The resistor has a contact surface in contact with the conductive seal. The contact surface includes: a portion where a distance in the central axis direction between the contact surface and a virtual plane changes according to a position on the contact surface where the virtual plane includes a rear end of the resistor and is vertical to the central axis; and at least one point where the distance is local maximum and at least one point where the distance is local minimum, in at least one cross section including the central axis.

The above-described configuration increases the area of the contact surface between the resistor and the conductive seal while suppressing shortening of the effective length of the resistor. As a result, this reduces sealing failure between the conductive seal and the resistor while suppressing decrease in radio-wave noise reduction performance.

Application Example 2

In accordance with a second aspect of the present invention, there is provided a spark plug according to application example 1, wherein at least a part of the resistor is positioned at the tip end side with respect to the rear end of the center electrode.

According to the above-described configuration, at least a part of the resistor is positioned at the tip end side with respect to the rear end of the center electrode. This expands the area of the contact portion between the resistor and the conductive seal without shortening the effective length of the resistor. As a result, this reduces sealing failure between the conductive seal and the resistor without shortening the radio-wave noise reduction performance.

Application Example 3

In accordance with a third aspect of the present invention, there is provided a spark plug that includes an insulator, a center electrode, a metal terminal nut, a resistor, and a conductive seal. The insulator extends along a central axis, and includes a through hole that passes through the insulator along the central axis. The center electrode extends along the central axis, and includes a rear end positioned inside of the through hole. The metal terminal nut extends along the central axis, and includes a tip end positioned at the rear end side with respect to the rear end of the center electrode inside of the through hole. The resistor is disposed in a position between the center electrode and the metal terminal nut inside of the through hole and apart from the center electrode. The conductive seal is disposed between the resistor and the center electrode inside of the through hole, and contacts both the center electrode and the resistor. At least a part of the resistor is positioned at the tip end side with respect to the rear end of the center electrode.

According to the above-described configuration, at least a part of the resistor is positioned at the tip end side with respect to the rear end of the center electrode. This expands the area of the contact portion between the resistor and the conductive seal without shortening the effective length of the resistor. As a result, this reduces sealing failure between the conductive seal and the resistor without shortening the radio-wave noise reduction performance.

Application Example 4

In accordance with a fourth aspect of the present invention, there is provided a spark plug according to application example 2 or 3, wherein the resistor includes a portion positioned at the tip end side with respect to the rear end of the center electrode over a whole circumference of a side surface of a rear end portion including the rear end of the center electrode.

According to the above-described configuration, a part of the resistor is positioned at the tip end side with respect to the rear end of the center electrode over the whole circumference of the side surface of the rear end portion at the center electrode. This further expands the area of the contact portion between the resistor and the conductive seal without shortening the effective length of the resistor. As a result, this further reduces sealing failure between the conductive seal and the resistor without shortening the radio-wave noise reduction performance.

Application Example 5

In accordance with a fifth aspect of the present invention, there is provided a spark plug according to application example 2 or 3, wherein a distance in the central axis direction between a tip end of the resistor and the rear end of the center electrode is equal to or less than 1.2 mm (millimeter).

The above-described configuration suppresses excessive reduction of the amount of the conductive seal. As a result, this suppresses decrease in load life performance of the spark plug.

Application Example 6

In accordance with a sixth aspect of the present invention, there is provided a spark plug according to any one of the application examples 1 to 5, wherein a distance in the central axis direction between the rear end of the center electrode and a tip end of the metal terminal nut is equal to or less than 13 mm (millimeter).

The above-described configuration reduces sealing failure between the conductive seal and the resistor while suppressing decrease in radio-wave noise reduction performance in a relatively compact spark plug where the distance in the center of axial direction between the rear end of the center electrode and the tip end of the metal terminal nut is equal to or less than 13 mm.

Application Example 7

In accordance with a seventh aspect of the present invention, there is provided a spark plug according to any one of the application examples 1 to 6 that further includes a metal shell that covers at least a partial range of an outer peripheral surface of the insulator in the central axis direction. The rear end of the resistor is at the tip end side with respect to a rear end of the metal shell.

The rear end of the resistor is disposed at the tip end side with respect to the rear end of the metal shell so as to reduce outward leakage of the radio wave noise. In this case, the length of the resistor is limited by the position of the rear end of the metal shell. Thus, it is difficult to ensure the effective length of the resistor. Even in this case, the above-described configuration facilitates ensuring the effective length of the resistor so as to reduce sealing failure between the conductive seal and the resistor while suppressing decrease in radio-wave noise reduction performance.

Application Example 8

In accordance to an eighth aspect of the present invention, there is provided a spark plug according to application example 7, wherein the insulator includes a large inner diameter portion, a small inner diameter portion, and an insulator shoulder portion. The small inner diameter portion is positioned at the tip end side with respect to the large inner diameter portion, and has a smaller inner diameter of the through hole than an inner diameter of the large inner diameter portion. The insulator shoulder portion is a shoulder portion disposed between the large inner diameter portion and the small inner diameter portion. The center electrode includes an electrode shoulder portion that is a shoulder portion with an outer diameter expanding from the tip end side toward the rear end side. The electrode shoulder portion is a shoulder portion disposed at the tip end side with respect to the rear end of the center electrode and is supported by the insulator shoulder portion. A portion of the center electrode at the rear end side with respect to the electrode shoulder portion, the conductive seal, and the resistor are disposed inside of the through hole in the large inner diameter portion of the insulator. A distance in the central axis direction between a tip end of the electrode shoulder portion and the rear end of the center electrode is equal to or more than 3.8 mm (millimeter).

In the case where the distance in the central axis direction between the tip end of the electrode shoulder portion and the rear end of the center electrode is equal to or more than 3.8 mm, the adhesion between the center electrode and the conductive seal improves. In this case, ensuring the effective length of the resistor becomes more difficult when the distance in the central axis direction between the tip end of the electrode shoulder portion and the rear end of the center electrode is equal to or more than 3.8 mm. In this case, the above-described configuration facilitates ensuring the effective length of the resistor so as to reduce sealing failure between the conductive seal and the resistor while suppressing decrease in radio-wave noise reduction performance.

Application Example 9

In accordance with a ninth aspect of the present invention, there is provided a spark plug according to any one of the application examples 1 to 8, wherein a minimum inner diameter of a portion where the resistor is disposed in the through hole of the insulator is equal to or less than 2.9 mm (millimeter).

In this relatively compact spark plug, the contact area between the resistor and the conductive seal are prone to be small. In this case, the above-described configuration expands this contact area while suppressing decrease in radio-wave noise reduction performance, thus reducing sealing failure between the conductive seal and the resistor.

BRIEF DESCRIPTION OF THE DRAWINGS

FIGS. 6(A) and 6(B) are examples showing the measurement result of the samples and the evaluation result of the samples.

DETAILED DESCRIPTION OF THE PREFERRED EMBODIMENTS

A. Embodiment

Figure 1:
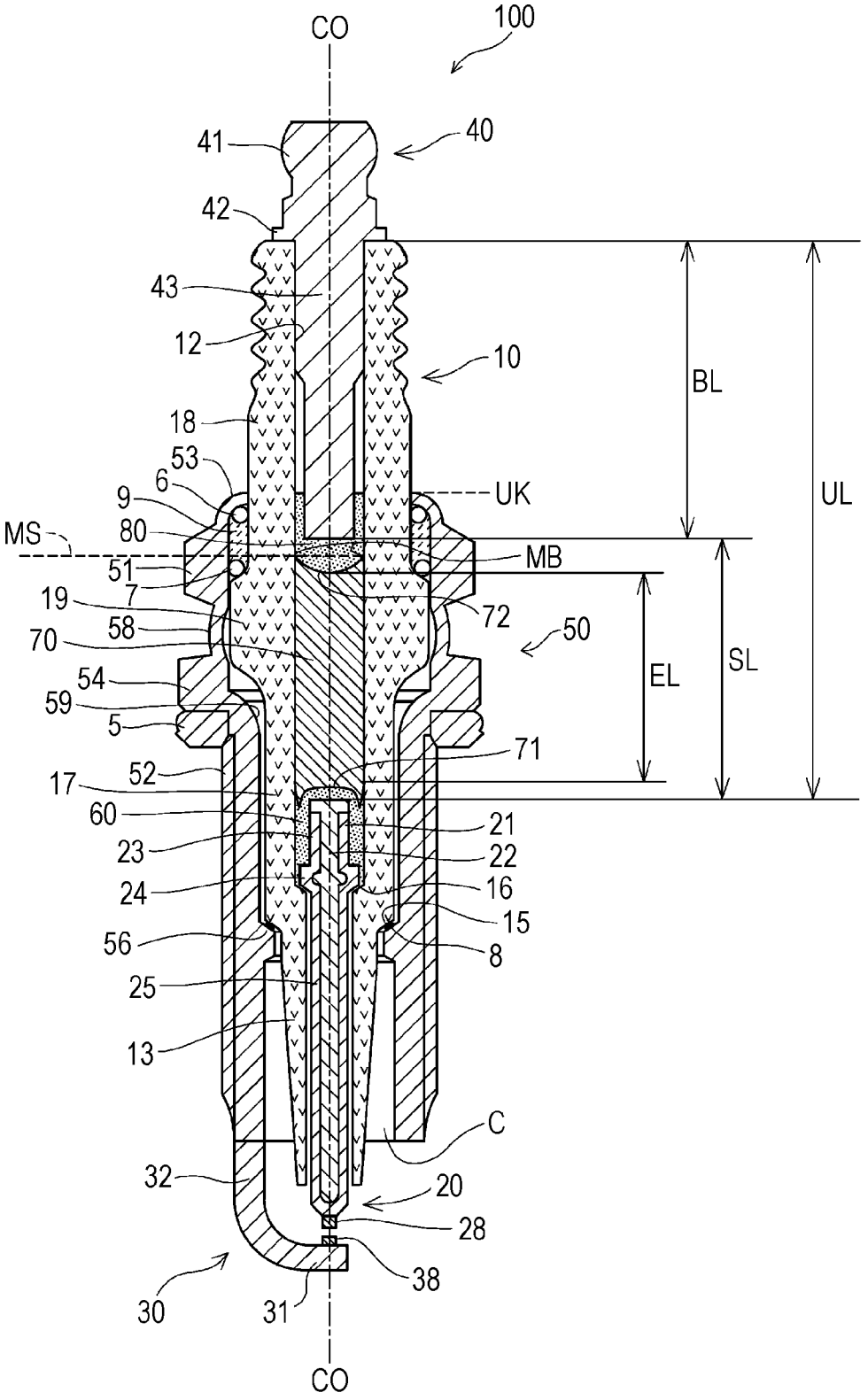
FIG. 1 is a sectional view of a spark plug, illustrating an embodiment of the invention.

A-1. Configuration of Spark Plug:

Hereinafter, an aspect of present invention will be described with reference to embodiments. FIG. 1 is a sectional view of a spark plug 100. The one-dot chain line in FIG. 1 indicates the central axis CO of the spark plug 100. A direction (the vertical direction in FIG. 1) parallel to the central axis CO is referred to as a central axis direction or an axial direction. The lower side in FIG. 1 is referred to as a tip end side of the spark plug 100. The upper side in FIG. 1 is referred to as a rear end side of the spark plug 100. The spark plug 100 includes a ceramic insulator 10 as an insulator, a center electrode 20, a ground electrode 30, a metal terminal nut 40, and a metal shell 50.

The ceramic insulator 10 is formed by sintering alumina and similar material. The ceramic insulator 10 is an approximately cylindrical shape member that extends along the central axis and has a through hole 12 (an axial hole) passing through the ceramic insulator 10. The ceramic insulator 10 includes a flange portion 19, a rear-end-side trunk portion 18, a tip-end-side trunk portion 17, a shoulder portion 15, and an insulator leg portion 13. The flange portion 19 is a portion positioned at approximately the center of the ceramic insulator 10 in the axial direction. The rear-end-side trunk portion 18 is positioned at the rear end side with respect to the flange portion 19, and has a smaller outer diameter than the flange portion 19. The tip-end-side trunk portion 17 is positioned at the tip end side with respect to the flange portion 19, and has a smaller outer diameter than the rear-end-side trunk portion 18. The insulator leg portion 13 is positioned at the tip end side with respect to the tip-end-side trunk portion 17, and has a smaller outer diameter than the tip-end-side trunk portion 17. The insulator leg portion 13 has a reduced diameter (i.e., is tapered) toward the tip end side, and is exposed to a combustion chamber of an internal combustion engine (not shown) when the spark plug 100 is installed on the internal combustion engine. The shoulder portion 15 is formed between the insulator leg portion 13 and the tip-end-side trunk portion 17.

The metal shell 50 is formed of conductive metallic material (for example, low-carbon steel material), and is a cylindrically-shaped metal shell to secure the spark plug 100 to an engine head (not shown) of the internal combustion engine. In the metal shell 50, an insertion hole 59 passes through the metal shell 50 along the central axis CO. The ceramic insulator 10 is inserted and held in the insertion hole 59 of the metal shell 50. The metal shell 50 covers a portion from a part of the rear-end-side trunk portion 18 of the ceramic insulator 10 to the insulator leg portion 13. The tip end of the ceramic insulator 10 is exposed from the tip end of the metal shell 50. The rear end of the ceramic insulator 10 is exposed from the rear end of the metal shell 50.

The metal shell 50 includes a hexagonal prism-shaped tool engagement portion 51 to engage a spark plug wrench, a mounting screw portion 52 for installation to the internal combustion engine, and a flanged seal portion 54 formed between the tool engagement portion 51 and the mounting screw portion 52. A length between mutually parallel side surfaces of the tool engagement portion 51, that is, a length between opposite sides is, for example, 9 mm to 14 mm. An outer diameter M (nominal diameter) of the mounting screw portion 52 is, for example, 8 mm to 12 mm.

An annular gasket 5 is fitted by insertion between the mounting screw portion 52 and the seal portion 54 in the metal shell 50. The gasket 5 is formed by folding a metal plate. The gasket 5 seals the clearance between the spark plug 100 and the internal combustion engine (the engine head) when the spark plug 100 is installed on the internal combustion engine.

The metal shell 50 further includes a thin walled caulking portion 53 and a thin walled compression deformation portion 58. The caulking portion 53 is disposed at the rear end side of the tool engagement portion 51. The compression deformation portion 58 is disposed between the seal portion 54 and the tool engagement portion 51. An annular region is formed between an inner peripheral surface in an area of the metal shell 50 from the tool engagement portion 51 to the caulking portion 53 and an outer peripheral surface of the rear-end-side trunk portion 18 of the ceramic insulator 10. In the annular region, annular ring members 6 and 7 are disposed. Powders of talc 9 are filled up between the two ring members 6 and 7 in this region. The rear end of the caulking portion 53 is folded radially inward, and secured to the outer peripheral surface of the ceramic insulator 10. Regarding the compression deformation portion 58 of the metal shell 50, during manufacturing, the caulking portion 53 secured to the outer peripheral surface of the ceramic insulator 10 is pushed toward the tip end side so that the compression deformation portion 58 is compressively deformed. The compression deformation of the compression deformation portion 58 pushes the ceramic insulator 10 toward the tip end side within the metal shell 50 via the ring members 6 and 7 and the talc 9. The shoulder portion 15 (an insulating-insulator-side shoulder portion) of the ceramic insulator 10 is pushed by the shoulder portion 56 (a metal-shell-side shoulder portion) formed in a position of the mounting screw portion 52 at the inner periphery of the metal shell 50, via an annular plate packing 8. As a result, the plate packing 8 prevents outward leakage of gas in the combustion chamber of the internal combustion engine from the clearance between the metal shell 50 and the ceramic insulator 10. On the tip end side with respect to the metal-shell-side shoulder portion 56, a clearance C with a predetermined dimension is disposed between the metal shell 50 and the insulator leg portion 13 of the ceramic insulator 10.

The center electrode 20 is a rod-shaped member that extends along the central axis CO. The center electrode 20 has a construction including an electrode base material 21 and a core material 22 buried inside of the electrode base material 21. The electrode base material 21 is formed of Nickel, or alloy (inconel (registered trademark) 600 or similar alloy) that contains Nickel, as a main constituent. The core material 22 is formed of copper, or alloy that contains copper, as a main constituent with excellent thermal conductivity compared with the alloy forming the electrode base material 21. In the center electrode 20, the greater portion including the rear end is positioned inside of the through hole 12 of the ceramic insulator 10. The tip end of the center electrode 20 is exposed at the tip end side of the ceramic insulator 10.

The center electrode 20 includes a flange portion 24 (referred to also as an electrode flange portion or a flanged portion), a head 23 (an electrode head), and a leg portion 25 (an electrode leg). The flange portion 24 is disposed in a predetermined position in the central axis direction. The head 23 is a portion at the rear end side with respect to the flange portion 24. The leg portion 25 is a portion at the tip end side with respect to the flange portion 24. The tip end portion of the leg portion 25 of the center electrode 20 has a tapered shape with a smaller diameter toward the tip end. An electrode tip 28 is sealed (i.e., attached) to this tip end portion, for example, by laser welding. The electrode tip 28 is formed of material that contains noble metal with high melting point as a main constituent. This material of the electrode tip 28 employs, for example, iridium (Ir) or an alloy containing Ir as a main constituent. Specifically, Ir-5Pt alloy (iridium alloy containing five mass % platinum) or similar alloy is frequently used.

The ground electrode 30 is sealed (i.e., attached) to the tip end of the metal shell 50. The electrode base material of the ground electrode 30 is formed of metal with a high corrosion resistance, for example, nickel alloy such as inconel (registered trademark) 600. A base-material base end portion 32 of this ground electrode 30 is sealed to the tip end face of the metal shell 50 by welding. A base-material tip end portion 31 of the ground electrode 30 is bent. One side surface of the base-material tip end portion 31 faces the electrode tip 28 of the center electrode 20 on the central axis CO in the axial direction. On the one side surface of the base-material tip end portion 31, an electrode tip 38 is welded by resistance welding in a position facing the electrode tip 28 of the center electrode 20. The electrode tip 38 employs, for example, Pt (platinum) or alloy containing Pt as a main constituent, specifically, Pt-20Ir alloy (platinum alloy containing 20 mass % of iridium) or similar alloy. A spark gap is formed between a pair of these electrode tips 28 and 38.

The metal terminal nut 40 is a rod-shaped member that extends along the central axis CO. The metal terminal nut 40 is formed of conductive metallic material (for example, low-carbon steel), and has a surface where an anticorrosion metal layer (for example, a Ni layer) is formed by plating or similar method. The metal terminal nut 40 includes a flange portion 42 (a terminal nut jaw portion), a plug cap installation portion 41, and a leg portion 43 (a terminal nut leg portion). The flange portion 42 is formed at a predetermined position in the central axis direction. The plug cap installation portion 41 is positioned at the rear end side with respect to the flange portion 42. The leg portion 43 is positioned at the tip end side with respect to the flange portion 42. The plug cap installation portion 41 including the rear end of the metal terminal nut 40 is exposed at the rear end side of the ceramic insulator 10. The leg portion 43 including the tip end of the metal terminal nut 40 is inserted (press-fitted) into the through hole 12 of the ceramic insulator 10. That is, the tip end of the metal terminal nut 40 is positioned inside of the through hole 12. A plug cap (not shown), connected to a high-voltage cable (not shown), is installed on the plug cap installation portion 41, and receives a high voltage for generating a spark.

Inside of the through hole 12 of the ceramic insulator 10, the tip end of the metal terminal nut 40 (the tip end of the leg portion 43) is positioned at the rear end side with respect to the rear end of the above-described center electrode 20. Inside of the through hole 12 of the ceramic insulator 10, a resistor 70 is disposed in a region between the tip end of the metal terminal nut 40 and the rear end of the center electrode 20 to reduce radio wave noise during sparking. The resistor is formed of compositions including glass particles as a main constituent, ceramic particles other than glass, and a conductive material. The conductive material includes, for example, a non-metal conductive material such as carbon particles (such as carbon black), TiC particles, and TiN particles and a metal such as Al, Mg, Ti, Zr, and Zn. The material of the glass particles can employ, for example, $B_2O_3$-$SiO_2$ system, BaO—$B_2O_3$ system, and $SiO_2$-$B_2O_3$-CaO—BaO system. The material of the ceramic particles can employ, for example, $TiO_2$ and $ZrO_2$. The resistance value of the resistor 70 is preferred to be, for example, 0.1 kΩ to 30 kΩ, and further preferred to be 1 kΩ to 20 kΩ.

The clearance between the resistor 70 and the center electrode 20 inside of the through hole 12 is filled up with a conductive seal 60. The clearance between the resistor 70 and the metal terminal nut 40 is filled up with the conductive seal 80. That is, the conductive seal 60 contacts both the resistor 70 and the center electrode 20, while the conductive seal 80 contacts both the resistor 70 and the metal terminal nut 40. As a result, the center electrode 20 and the metal terminal nut 40 are electrically connected to each other via the resistor 70 and the conductive seals 60 and 80. The conductive seal includes, for example, the above-described various glass particles and metal particles (such as Cu and Fe) in a ratio of about 1 to 1. The conductive seal has properties intermediate between: the material property of the center electrode 20 and the metal terminal nut 40 as metals, and the material property of the resistor 70 that includes glass as a main constituent. As a result, interposing the conductive seals 60 and 80 stabilizes the contact resistance between the laminated members, thus stabilizing the resistance value between the center electrode 20 and the metal terminal nut 40.

Here, a rear end MB of the resistor 70 is positioned at the tip end side with respect to a rear end UK of the metal shell 50. That is, the outer peripheral surface of the ceramic insulator 10 is covered with the metal shell 50 over the whole range where the resistor 70 is disposed in the central axis direction. As a result, the radio wave noise emitted from the spark plug 100 to the outside is blocked by the metal shell 50. This reduces the radio wave noise emitted from the spark plug 100.

From the aspect of ensuring the compact spark plug 100, a distance UL in the center of axial direction between the rear end of the ceramic insulator 10 and the rear end of the center electrode 20 (the rear end of the head 23) is preferred to be equal to or less than 25 mm. Also, from the aspect of productivity, an insulator nose length BL (a distance in the central axis direction between the tip end of the flange portion 42 and the tip end of the leg portion 43 of the metal terminal nut 40) in the central axis direction of the leg portion 43 of the metal terminal nut 40 is preferred to be equal to or more than 12 mm. Accordingly, in the case where these conditions are satisfied, a distance SL (this distance is also referred to as seal length SL) in the central axis direction between the tip end of the metal terminal nut 40 and the rear end of the center electrode 20 is equal to or less than 13 mm.

Here, the radio-wave noise reduction performance by the resistor 70 depends on the effective length EL of the resistor 70. The effective length EL is a distance between the tip end of a rear end face 72 (a contact surface between the resistor 70 and the conductive seal 80) of the resistor 70 and the rear end of a tip end face 71 (a contact surface between the resistor 70 and the conductive seal 60) of the resistor 70. In the compact spark plug 100 where the above-described conditions of the distance UL and the insulator nose length BL are satisfied, it is especially desired to improve the radio-wave noise reduction performance by ensuring the longest possible effective length EL in a range that the above-described seal length SL equal to or less than 13 mm.

Figure 2:
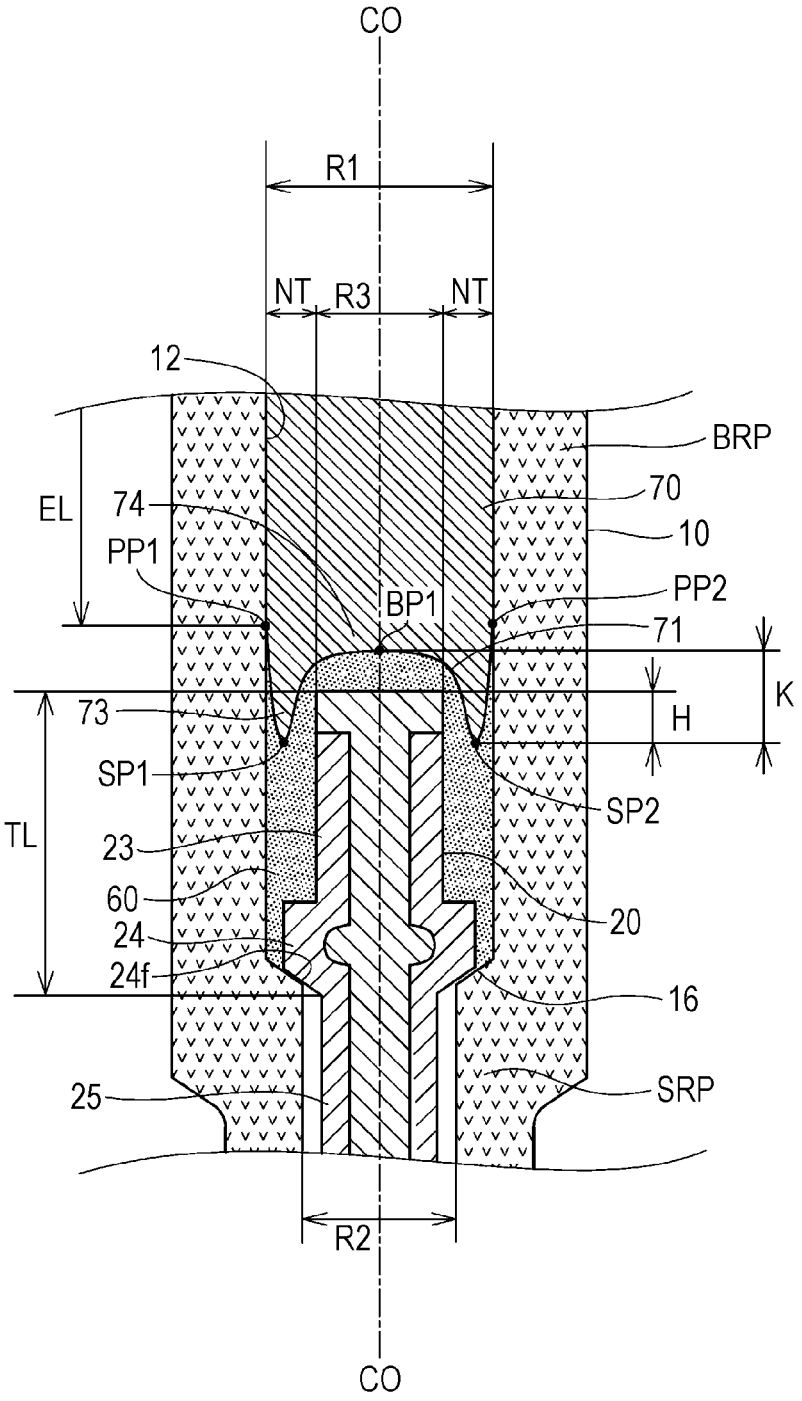
FIG. 2 is a diagram showing a structure in the proximity of a head of an electrode base material and a tip end face of a resistor.

With reference to FIG. 2, a further description will be given. FIG. 2 is a view showing a structure in the proximity of the head 23 of the electrode base material 21 and the tip end face 71 of the resistor 70. FIG. 2 shows a cross section of the spark plug 100 taken along the cross section including the central axis CO. The through hole 12 of the ceramic insulator 10 has inner diameter that differs on the tip end side and the rear end side in the proximity of the location of the flange portion 24 of the center electrode 20. That is, seen from the aspect of the inner diameter of the through hole 12, the ceramic insulator 10 includes a large inner diameter portion BRP that has a first diameter R1 as the inner diameter of the through hole 12 and a small inner diameter portion SRP that has a second diameter R2 smaller than the first diameter R1 as the inner diameter of the through hole 12. The small inner diameter portion SRP is positioned at the tip end side with respect to the large inner diameter portion BRP. A shoulder portion 16 (referred to also as an insulator shoulder portion 16) is disposed between the large inner diameter portion BRP and the small inner diameter portion SRP. The shoulder portion 16 is a portion where the inner diameter of the through hole 12 decreases from the first diameter R1 to the second diameter R2, heading from the rear end side toward the tip end side. Here, the first diameter R1 is, for example, 2.0 mm to 4.0 mm, and equal to or less than 2.9 mm in the compact spark plug 100. The second diameter R2 is 1.0 mm to 3.2 mm, and equal to or less than 2.4 mm in the compact spark plug 100. In the case where, for example, the first diameter R1 is relatively small (for example, the first diameter R1 is equal to or less than 2.9 mm), the tip end face 71 of the resistor 70 has a small area. The smaller area of the tip end face 71 more easily causes peeling between the conductive seal 60 and the resistor 70 in the case where an impact (for example, an impact caused by vibration of the internal combustion engine) is applied to the tip end face 71 of the resistor 70 (the contact surface between the conductive seal 60 and the resistor 70). Thus, the impact resistance of the spark plug 100 is prone to decrease. Accordingly, it is, especially, desired to improve impact resistance in the compact spark plug 100 with the relatively small first diameter R1.

The flange portion 24 (the flanged portion) of the center electrode 20 includes a shoulder portion 24*f* at the tip end side (referred to as an electrode shoulder portion 24*f*). The electrode shoulder portion 24*f* is a portion where the outer diameter increases from the tip end side toward the rear end side. The electrode shoulder portion 24*f* is supported by the insulator shoulder portion 16. Accordingly, the head 23 of the center electrode 20 is disposed inside of the through hole 12 in the large inner diameter portion BRP of the ceramic insulator 10. The leg portion 25 of the center electrode 20 is disposed inside of the through hole 12 in the small inner diameter portion SRP of the ceramic insulator 10. The side surface of the head 23, and the side surface and the rear end face of the flange portion 24 are in contact with conductive seal 60. Here, in the center electrode 20, a length TL (a distance TL in the central axis direction between the tip end of the flange portion 24 and the rear end of the head 23) from the tip end of the flange portion 24 (that is, the tip end of the electrode shoulder portion 24*f*) to the rear end of the head 23 (that is, the rear end of the center electrode 20) is preferred to be equal to or more than 3.8 mm. In this case, the volume of the head 23 becomes relatively large. This reduces temperature rise of the head 23 due to heat generated by the internal combustion engine, thus reducing thermal expansion of the head 23. As a result, this improves adhesion between the center electrode 20 and the conductive seal 60, thus prolonging the service life of the spark plug 100. In the case where the length TL from the tip end of the flange portion 24 to the rear end of the head 23 is relatively long (for example, the length TL is equal to or more than 3.8 mm), it is difficult to ensure the compact spark plug 100 and seal length SL at the same time. Therefore, it is especially desired to improve the radio-wave noise reduction performance by ensuring the longest possible effective length EL with a relatively short seal length SL.

Additionally, a head outer diameter R3 of the head 23 is preferred to be set, for example, within a range of 60% to 70% of the first diameter R1 to ensure the clearance NT at the head side surface. It is preferred to ensure the clearance NT at the head side surface to an extent of 0.4 mm to 0.6 mm.

In the spark plug 100 of this embodiment, the shape of the tip end face 71 of the resistor 70 is devised to ensure the compatibility between ensuring the effective length EL of the resistor 70 and expanding the area of the tip end face 71. Hereinafter, the shape of the tip end face 71 will be described.

The tip end face 71 has a peripheral edge portion 73 that includes a portion projecting further toward the tip end side of a center portion 74 of the tip end face 71 over the whole circumference. A detailed description will be given using a distance in the central axis direction (an axial distance) between the rear end MB of the resistor 70 (a virtual plane MS (in FIG. 1) that includes the rear end MB and is vertical to the central axis CO) and a point on the tip end face 71, that is, a length from the rear end MB of the resistor 70 to the point on the tip end face 71. In the cross section including the central axis CO of the resistor 70 (in FIG. 2), the tip end face 71 includes two local maximum points SP1 and SP2 at the local maximum axial distance and a local minimum point BP1 at the local minimum axial distance. That is, the axial distance becomes larger from a first contact position PP1 with the inner peripheral surface of the ceramic insulator 10 toward the central axis CO in the cross section shown in FIG. 2, and has the local maximal value at the first local maximum point SP1. Then, the axial distance becomes smaller from the first local maximum point SP1 toward the central axis CO, and has the local minimal value at the local minimum point BP1 near the central axis CO. Additionally, the axial distance becomes local maximum at the second local maximal value SP2 between the central axis CO and a second contact position PP2 with the inner peripheral surface of the ceramic insulator 10 to have a shape that is approximately line-symmetrical to the shape from the first contact position PP2 to the central axis CO with respect to the target axis of the central axis CO.

Here, the local maximum points SP1 and SP2 of the tip end face 71 are positioned at the tip end side with respect to the rear end of the head 23 of the center electrode 20. That is, the resistor 70 includes a portion positioned at the tip end side with respect to the rear end of the center electrode 20. Here, the peripheral edge portion 73 including the local maximum points SP1 and SP2 in the cross section shown in FIG. 2 includes a portion positioned at the tip end side with respect to the rear end of the side surface of the head 23 over the whole circumference on the side surface of the head 23 of the center electrode 20 (over the whole circumference of the inner peripheral surface of the ceramic insulator 10). That is, the tip end face 71 includes a portion in a bowl shape (an inversed bowl shape in the orientation of the illustration shown in FIG. 2) where the local minimum point BP1 is on the bottom portion side and the local maximum points SP1 and SP2 are on the opening side. The rear end of the center electrode 20 is positioned at the bottom portion side (the rear end side) with respect to the opening of the bowl shape. The outer surface (the side surface and the rear end face) of the head 23 of the center electrode 20 is not in contact with the tip end face 71, and is separated from the tip end face 71 by the conductive seal 60.

A-2. Method for Manufacturing the Spark Plug:

The above-described spark plug 100 can be manufactured by, for example, the following manufacturing method. First, a ceramic insulator assembly (an assembly where the center electrode 20, the metal terminal nut 40, the resistor 70, and similar member are assembled to the ceramic insulator 10) manufactured through a manufacturing process described later, the metal shell 50, and the ground electrode 30 are prepared. Subsequently, the metal shell 50 is assembled to the outer periphery of the ceramic insulator assembly, and the base-material base end portion 32 of the ground electrode 30 is sealed to the tip end face of the metal shell 50. The electrode tip 38 is welded to the base-material tip end portion 31 of the sealed ground electrode 30. Subsequently, the ground electrode 30 is bent so that the base-material tip end portion 31 of the ground electrode 30 faces the tip end portion of the center electrode 20. Thus, the spark plug 100 is completed.

Figure 3:
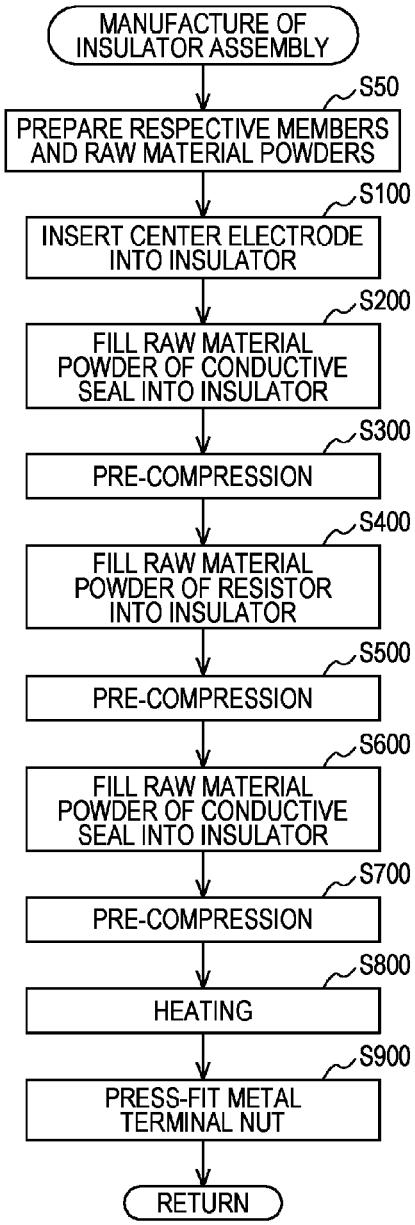
FIG. 3 is a flowchart of a manufacturing process of an insulator assembly.

A description will be given of the manufacturing process of the insulator assembly with reference to FIG. 3. FIG. 3 is a flowchart of the manufacturing process of the insulator assembly. FIGS. 4(A) to 4(D) are diagrams for explaining the manufacture of the insulator assembly. In step S50, necessary members and raw material powders, specifically, the ceramic insulator 10, the center electrode 20 where the electrode tip 28 is sealed to its tip end, the metal terminal nut 40, and the respective raw material powders 65, 85, and 75 of the conductive seals 60 and 80 and the resistor 70 are prepared.

In step S100, the center electrode 20 is inserted from the opening of the rear end inside of the through hole 12 of the prepared ceramic insulator 10. As described above with reference to FIG. 2, the center electrode 20 is supported by the shoulder portion 16 of the ceramic insulator 10 and secured inside of the through hole 12 (FIG. 4(A)).

In step S200, the raw material powder 65 of the conductive seal 60 is filled into the through hole 12 of the ceramic insulator 10 from the opening of the rear end, that is, the upper side of the center electrode 20. In step S300, pre-compression is performed on the raw material powder 65 filled inside of the through hole 12. The pre-compression is performed by compressing the raw material powder 65 using a compression rod member 200. The compression rod member 200 is a rod-shaped member that has an outer diameter slightly smaller than the first diameter R1 of the through hole 12. The tip end of the compression rod member 200 has a planar surface vertical to the axial direction of the compression rod member 200. The rear end face of the raw material powder 65 after the pre-compression has a planar shape vertical to the central axis CO.

In step S400, the raw material powder 75 of the resistor 70 is filled into the through hole 12 of the ceramic insulator 10 from the opening of the rear end, that is, from the upper side of the raw material powder 65. In step S500, similarly to step S300 described above, the pre-compression is performed on the raw material powder 75 filled inside of the through hole 12 using the compression rod member 200. The filling of the raw material powder 75 (in S400) and the pre-compression (in 5500) can be performed over several cycles For example, filling of a half of the prescribed filling quantity of the raw material powder 75 and the pre-compression after the filling are each performed twice in alternation.

In step S600, the raw material powder 85 of the conductive seal 80 is filled into the through hole 12 of the ceramic insulator 10 from the opening of the rear end, that is, from the upper side of the raw material powder 75. In step S700, similarly to step S300 described above, the pre-compression is performed on the raw material powder 85 filled inside of the through hole 12 using the compression rod member 200.

Figure 4:
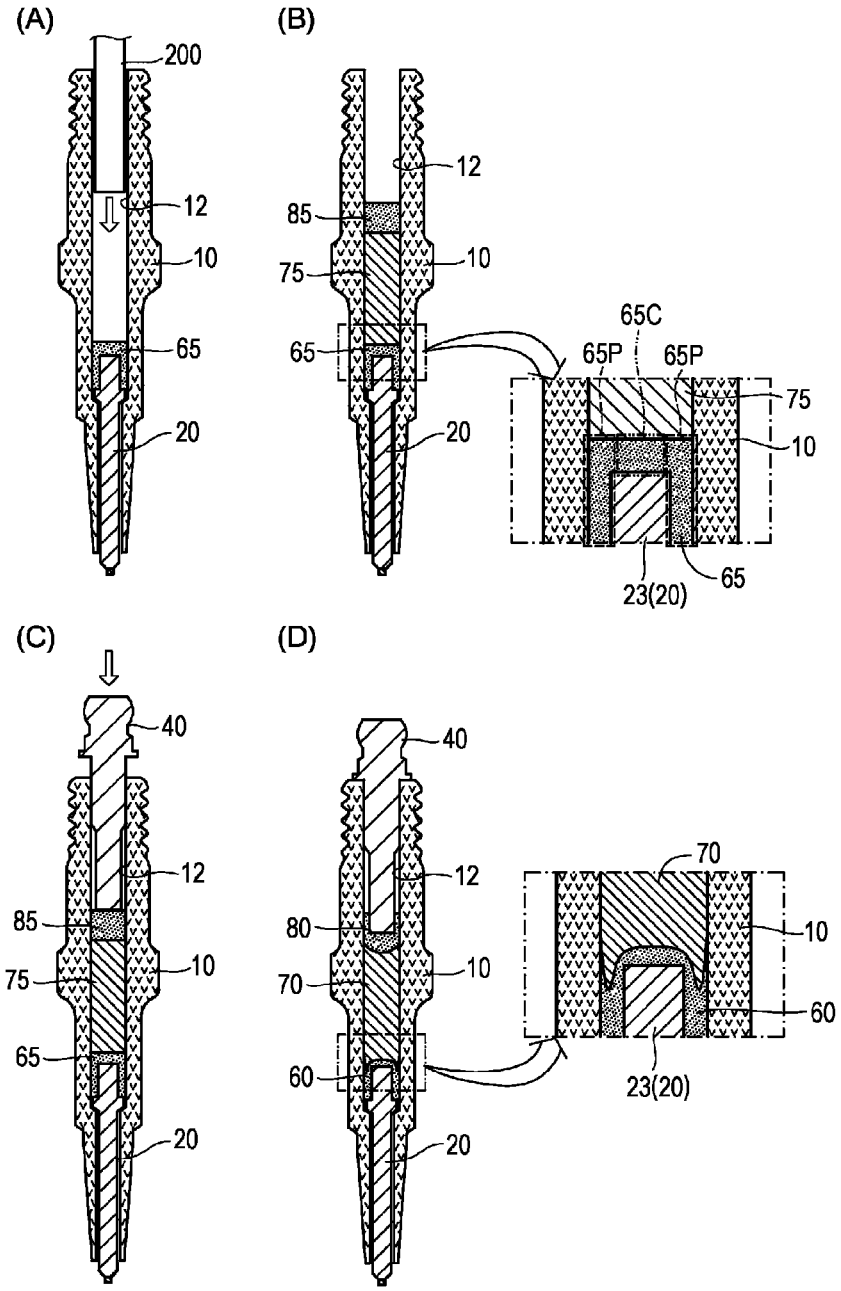
FIGS. 4(A) to 4(D) are diagrams for explaining the manufacture of the insulator assembly.

FIG. 4(B) shows the center electrode 20 and the raw material powders 65, 75, and 85 that are inserted and filled into the ceramic insulator 10 and the through hole 12 of the ceramic insulator 10 at the time the manufacturing process up to step S700 is completed. Here, the partial expansion figure of FIG. 4(B) shows a central portion 65C where the head 23 of the center electrode 20 is present on tip end side and a peripheral edge portion 65P where the head 23 of the center electrode 20 is not present on the tip end side in the filled raw material powder 65. The central portion 65C includes a region through which the central axis CO passes. The peripheral edge portion 65P includes a ring-shaped region surrounding the radially outside of the central portion 65C.

In the pre-compression (in S300), the pressure applied to the central portion 65C is higher than a pressure applied to the peripheral edge portion 65P. That is, the peripheral edge portion 65P receives a relatively low pressure to be sandwiched between: the tip end face of the compression rod member 200; and the rear end face of the head 23 at a relatively close distance to this tip end face. On the other hand, the central portion 65C receives a relatively high pressure to be sandwiched between: the tip end face of the compression rod member 200; and the rear end faces of the flange portion 24 and the shoulder portion 16 relatively far distance from this tip end face.

As a result, the raw material powder 65 has a density in the peripheral edge portion 65P that is lower than a density of the raw material powder 65 in the central portion 65C.

In this state, in step S800, the ceramic insulator 10 is transferred into a tunnel kiln and heated to a predetermined temperature. The predetermined temperature is, for example, a temperature higher than the softening point of glass constituent contained in the raw material powders 65, 75, and 85, specifically, 800 to 950 degrees Celsius. In a state heated to the predetermined temperature, in step S900, the metal terminal nut 40 is press-fitted in the central axis direction from the opening of the rear end of the through hole 12 in the ceramic insulator 10 (in FIG. 4(C)). As a result, the respective raw material powders 65, 75, and 85 laminated inside of the through hole 12 of the ceramic insulator 10 are pressed (compressed) in the central axis direction by the tip end of the metal terminal nut 40. As a result, as shown in FIG. 4(D), the respective raw material powders 65, 75, and 85 are compressed and sintered to form the respective conductive seal 60, resistor 70, and conductive seal 80 described above. The insulator assembly is completed through the above-described manufacturing process.

Here, as described above, the raw material powder 65 before compression and sintering has a difference in density between the central portion 65C and the peripheral edge portion 65P. As a result, in the peripheral edge portion 65P, the tip end portion of the resistor 70 to be molded by compression and sintering is molded to extend to the tip end side with respect to the central portion 65C. A distance H and a distance K shown in FIG. 2 depend on the difference in density (referred to also as a difference in raw material powder density) generated between the central portion 65C and the peripheral edge portion 65P in the raw material powder 65 before compression and sintering. The distance H is a distance in the central axis direction between the tip end of the resistor 70 (the tip ends SP1 and SP2 of the peripheral edge portion 73) and the rear end of the center electrode 20 (the head 23) (see FIG. 2). The distance H is, in other words, a penetrating length of the tip end of the resistor 70 into the tip end side with respect to the rear end of the center electrode 20. Thus, the distance H is also referred to as a penetration length H below. The distance K is a distance in the central axis direction between the rear end of the center portion 74 and the tip end of the peripheral edge portion 73 (see FIG. 2). The distance K is, in other words, a projecting length of the tip ends SP1 and SP2 of the peripheral edge portion 73 toward the tip end side with respect to the center portion 74 adjacent to the central axis CO in the tip end face 71 of the resistor 70. Thus, the distance K is also referred to as a projection length K below.

That is, a larger difference in raw material powder density ensures larger penetration length H and projection length K. A smaller difference in raw material powder density ensures smaller penetration length H and projection length K. The difference in raw material powder density depends on a filling quantity of the raw material powder 65. That is, a smaller filling quantity of the raw material powder 65 ensures larger penetration length H and projection length K. This is because the smaller filling quantity of the raw material powder 65 ensures a larger ratio of the volume of the peripheral edge portion 65P to the volume of the central portion 65C, and this result in a difference in compression ratio by the pre-compression consequently becomes larger. Here, a larger projection length K and penetration length H ensure a larger area of the tip end face 71 of the resistor 70. However, in the case where the filling quantity of the raw material powder 65 becomes smaller than a specific value, the amount of the conductive seal 60 at the completion becomes excessively small. Thus, the center electrode 20 and the resistor 70 directly contact each other, and the thickness of the conductive seal 60 over the head 23 becomes excessively thin. As a result, as described later, a resistance value between the center electrode 20 and the resistor 70 is not stabilized, and the load life of the spark plug 100 may become shorter. Accordingly, the filling quantity of the raw material powder 65 is preferred to be designed considering a balance between maintaining the load life and expanding the area of the tip end face 71 of the resistor 70. The sizes of the penetration length H and the projection length K depend also on a distance NT (FIG. 2: referred to also as a clearance NT of the head side surface) between the side surface of the head 23 of the center electrode 20 and the inner peripheral surface of the ceramic insulator 10. It is preferred that the size of the clearance NT of the head side surface be also considered.

According to the spark plug 100 of this embodiment, the above-described configuration and manufacturing method of which have been described above, the contact surface (the tip end face 71) between the resistor 70 and the conductive seal 60 has a plurality of points (SP1, SP2, and BP1) where the distance in the central axis direction from the rear end of the resistor 70 becomes local maximum or local minimum in the cross section including the central axis CO. This increases a contact area between the resistor 70 and the conductive seal 60 while restricting the effective length EL of the resistor 70 to be short. As a result, this reduces sealing failure (peeling) between the conductive seal and the resistor while suppressing decrease in radio-wave noise reduction performance, thus improving impact resistance.

Figure 5:
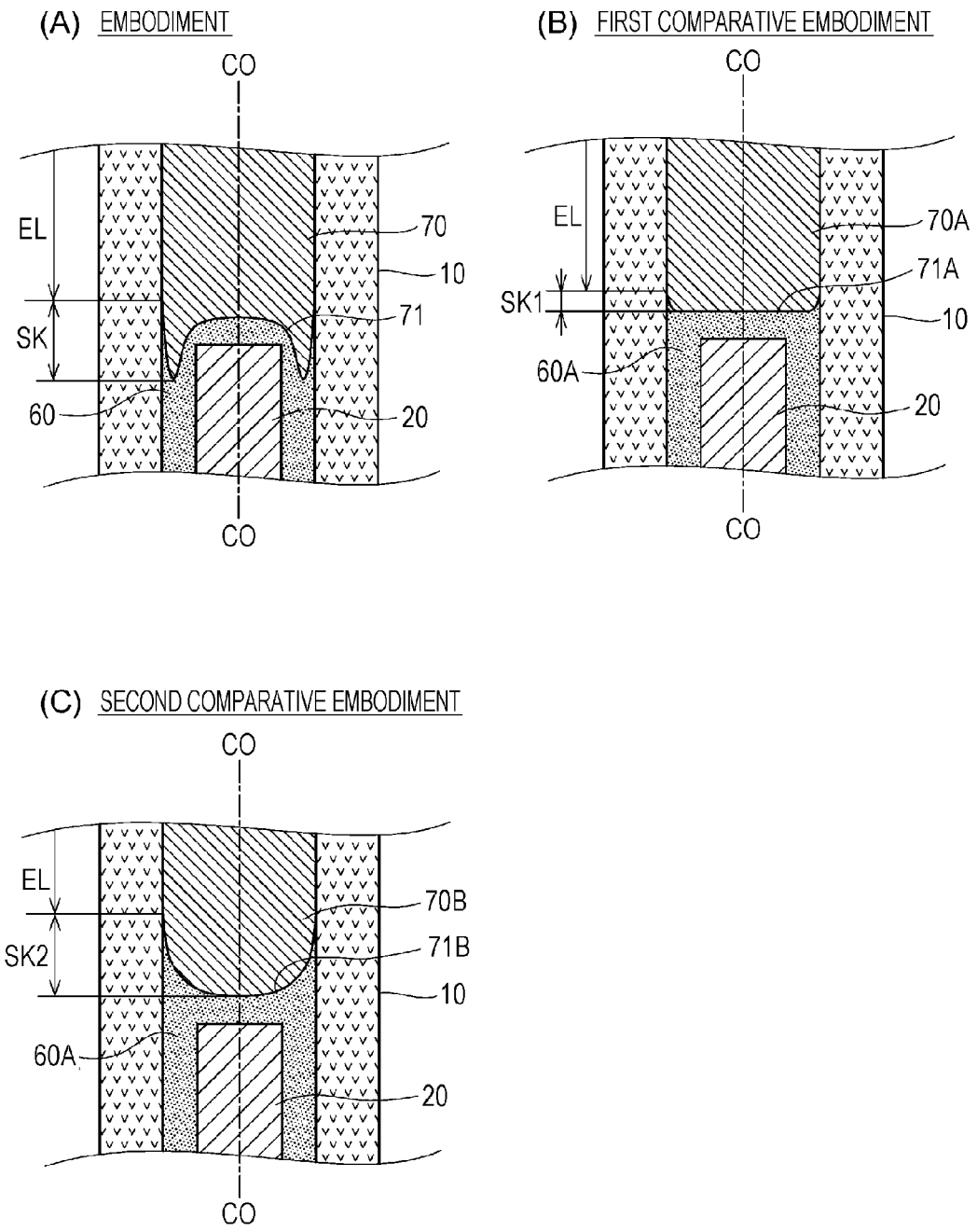
FIGS. 5(A) to 5(C) are diagrams exemplarily showing comparative embodiments.

FIGS. 5(A) to 5(C) are diagrams exemplarily showing comparative embodiments. Like first and second comparative embodiments shown in FIGS. 5(B) and 5(C), in the case where the tip end face of the resistor has only one local maximum or local minimum point in the cross section including the central axis CO of the resistor, this configuration does not sufficiently achieve the compatibility between ensuring the effective length EL of the resistor and expanding the area of the tip end face of the resistor. For example, a spark plug of the first comparative embodiment shown in FIG. 5(B) is an example where a distance SK1 in the central axis direction between the tip end and the rear end at a tip end face 71A of a resistor 70A is relatively short. In this example, the tip end face 71A of the resistor 70A has an approximately flat shape. In this case, since the distance SK1 is relatively short, the proportion of the effective length EL to the overall length of the resistor 70A (a length from the rear end to the tip end of the resistor 70) can be set relatively large. However, the area ratio of the tip end face 71A to the area of the cross section perpendicular to the central axis CO of the through hole 12 cannot be set large. That is, the area of the tip end face 71A cannot be set sufficiently large, and this might not sufficiently reduce the sealing failure (peeling) between the conductive seal 60A and the resistor 70A.

A spark plug of the second comparative embodiment shown in FIG. 5(C) is an example where a distance SK2 in the central axis direction between the tip end and the rear end at a tip end face 71B of a resistor 70B is relatively long. In this case, since the distance SK2 is relatively long, the area ratio of the tip end face 71B to the area of the cross section perpendicular to the central axis CO of the through hole 12 can be set large to some extent. However, the proportion of the effective length EL to the overall length of the resistor 70B becomes small. That is, this does not ensure a sufficient effective length EL, and may cause decrease in radio-wave noise reduction performance.

On the other hand, in the spark plug 100 of this embodiment (in FIG. 2 and FIG. 5(A)), the tip end face 71 is constituted in a wavelike shape to have the local maximum points SP1, SP2, and BP1 in the cross section shown in FIG. 2 even in the case where the distance SK in the central axis direction between the tip end and the rear end at the tip end face 71 of the resistor 70 is relatively small. This can sufficiently expand the area of the tip end face 71. Accordingly, as described above, this reduces sealing failure (peeling) between the conductive seal and the resistor while suppressing decrease in radio-wave noise reduction performance, thus improving the impact resistance.

Furthermore, the resistor 70 includes the portion positioned at the tip end side with respect to the rear end of the center electrode 20 to expand the area of the tip end face 71 without shortening the effective length EL of the resistor 70. As a result, this further reduces sealing failure between the conductive seal 60 and the resistor 70 without shortening the radio-wave noise reduction performance. In this embodiment, the resistor 70 includes the portion positioned at the tip end side with respect to the rear end of the side surface of the head 23 over the whole circumference of the side surface of the head 23 in the center electrode 20. Accordingly, the area of the tip end face 71 can be expanded more efficiently.

Here, penetration length H (the distance H (in FIG. 2) in the central axis direction between the tip end of the resistor 70 and the rear end of the center electrode 20 (the head 23)) is preferred to be equal to or less than 1.2 mm. The penetration length H equal to or less than 1.2 mm suppresses excessive reduction of the amount of the conductive seal 60 arranged between the resistor 70 and the center electrode 20. If the amount of the conductive seal 60 arranged between the center electrode 20 and the resistor 70 is excessively reduced, the resistance value between the center electrode 20 and the resistor 70 is not stabilized. Therefore, the load life performance of the spark plug 100 may be decreased. In the case where the clearance NT of the head side surface is, for example, in a range of 0.2 mm<NT<0.5 mm, specifically the penetration length H equal to or less than 1.2 mm suppresses excessive reduction of the amount of the conductive seal 60 arranged between the resistor 70 and the center electrode 20.

In the case where the distance (the seal length SL) in the central axis direction between the rear end of the center electrode 20 and the tip end of the metal terminal nut 40 is equal to or less than 13 mm (millimeter), this reduces sealing failure between the conductive seal 60 and the resistor 70 while suppressing decrease in radio-wave noise reduction performance within the limitations of the seal length SL.

In this embodiment, the rear end MB of the resistor 70 can be positioned at the tip end side with respect to the rear end UK of the metal shell 50 without shortening the effective length EL of the resistor 70. As a result, as described above, the radio wave noise emitted from the spark plug 100 to the outside is blocked by the metal shell 50. This reduces the radio wave noise emitted from the spark plug 100.

Additionally, in the case where the distance in the central axis direction between the tip end of the flange portion 24 and the rear end of the center electrode 20 is set equal to or more than 3.8 mm, it is more difficult to ensure the effective length EL of the resistor 70 restricted by the position of the rear end of the metal shell 50. In this case, the above-described embodiment facilitates ensuring the effective length EL of the resistor 70 so as to reduce sealing failure between the conductive seal 60 and the resistor 70 while suppressing decrease in radio-wave noise reduction performance.

Additionally, in the case where the inner diameter (seal diameter) at the position where the resistor 70 is disposed in the through hole 12 of the ceramic insulator 10 is equal to or less than 2.9 mm, the area of the tip end face 71 is prone to be small. In the case where the inner diameter of the portion where the resistor 70 is disposed in the through hole 12 changes according to the position parallel to the central axis CO, the area of the tip end face 71 is prone to be small similarly to the case where the minimum inner diameter of the portion where the resistor 70 is disposed in the through hole 12 is equal to or less than 2.9 mm. This relatively compact spark plug efficiently expands this contact area while suppressing decrease in radio-wave noise reduction performance, thus reducing sealing failure between the conductive seal 60 and the resistor 70.

A-3. Working Example

A plurality of samples #1 to #16, different in projection length K and penetration length H, of the spark plug 100 in the above-described embodiment were manufactured, and evaluation tests were performed. The respective samples were manufactured in accordance with the above-described manufacturing process. In order to vary the projection length K and the penetration length H, the filling quantity of the raw material powder 65 is varied among the samples. The manufacturing conditions other than the filling quantity of the raw material powder 65, for example, the filling quantity of the raw material powder 75 of the resistor 70, the respective members (the ceramic insulator 10, the center electrode 20, the metal shell 50, and the metal terminal nut 40) are not varied between the samples.

Various dimensions of the spark plug 100 that are common to the respective samples are as follows.

Figure 7:
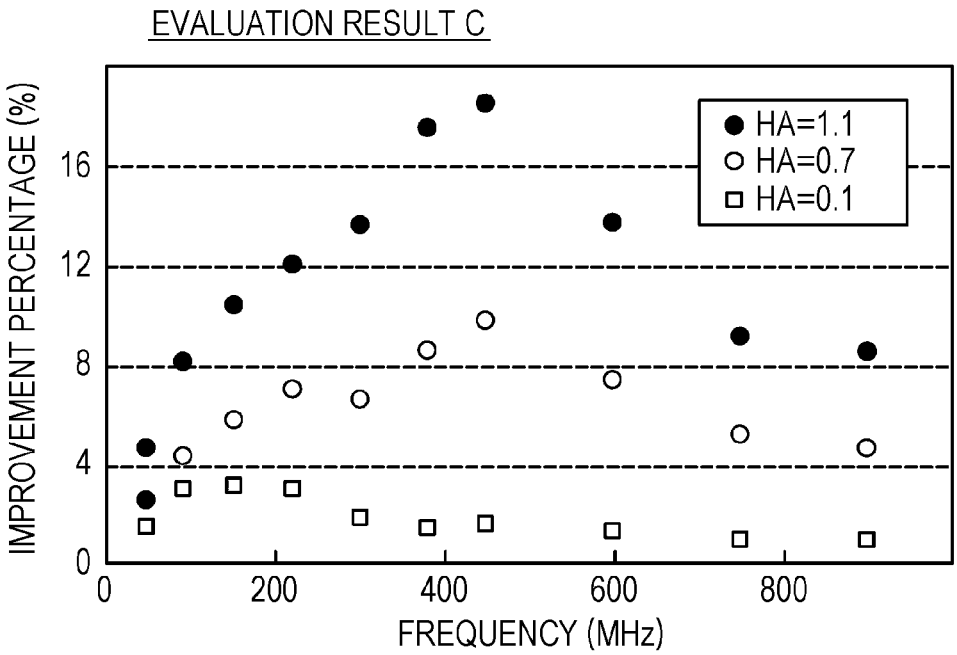
FIG. 7 is an example showing the measurement result of the samples and the evaluation result of the samples.

The first diameter R1 of the large inner diameter portion BRP of the ceramic insulator 10 (in FIG. 2): 3.0 mm The second diameter R2 of the small inner diameter portion SRP of the ceramic insulator 10 (in FIG. 2): 2.0 mm The outer diameter R3 of the head 23 of the center electrode 20 (in FIG. 2): 2.1 mm The clearance NT of the head side surface (in FIG. 2): 0.45 mm The length TL from the tip end of the flange portion 24 to the rear end of the head 23: 3.5 mm The distance UL between the rear end of the ceramic insulator 10 and the rear end and of the center electrode 20: 47.5 mm The insulator nose length BL of the metal terminal nut 40 (in FIG. 1): 36.5 mm The seal length SL (in FIG. 1): 11.0 mm FIGS. 6(A) and 6(B) and FIG. 7 are examples showing the measurement result of the samples and the evaluation result of the samples. In this working example, eight types of Samples #1 to #16 were manufactured in pluralities in which filling quantities of the raw material powder 65 are each different. Subsequently, each of Samples #1 to #8 manufactured in the respective pluralities was individually sectioned along the cross section including the central axis CO. The minimum penetration length HA, the minimum projection length KA, the maximum penetration length HD, and the maximum projection length KD among the penetration lengths H and the projection lengths K in the peripheral edge portion 73 over the whole circumference were each measured (in FIG. 6(A)). It may be said that if these values HA, KA, HD, and KD become larger, the area of the tip end face 71 becomes larger. Additionally, each one of the plurality of the respective manufactured Samples #9 to #16 was sectioned along the cross section including the central axis CO. The minimum penetration length HA among the penetration lengths H in the peripheral edge portion 73 over the whole circumference was measured (in FIG. 6(B)).

A-3-1. Test of Impact Resistance:

An impact resistance test was carried out using the Samples #1 to #8. The impact resistance test was carried out based on test conditions compliant with Japanese Industrial Standard B8031: 2006 (internal combustion engine-spark plug) section 7.4. However, a condition (30 minutes) more severe than the stipulation (10 minutes) of Japanese Industrial Standard was adopted as duration for applying the impact. The impact resistance was evaluated using a changing rate of the resistance value between the metal terminal nut 40 and the center electrode 20 before and after the test. The evaluation standard of this test is as follows.

Evaluation Result A: the changing rate is equal to or less than ±15%, Evaluation Result B: the changing rate is equal to or less than ±25%, Evaluation Result C: the changing rate is equal to or less than ±30%, and Evaluation Result D: the changing rate is equal to or more than ±30.

As shown in FIG. 6(A), respective evaluation results of the impact resistance of Samples #1 to #8 were either the evaluation result A or the evaluation result B. As apparent from FIG. 6(A), it was confirmed that the impact resistance tended to improve when the minimum penetration length HA, the minimum projection length KA, the maximum penetration length HD, and the maximum projection length KD became larger, that is, the area of the tip end face 71 became larger.

A-3-2. Reduction Performance Test for Radio Wave Noise:

A reduction performance test for radio wave noise was carried out using Samples #9 to #16. Specifically, the electrical field intensity of the interfering wave emitted from the spark plug as each sample was measured in a range of test frequency of 50 to 900 MHz by measuring procedure specified by International Special Committee on Radio Interference standard (CISPR). The radio-wave noise reduction performance was evaluated using an improvement rate of attenuation with reference to the attenuation (units were decibels: the attenuation compared with the spark plug without the resistor) of the electrical field intensity of the interfering wave in Sample #10 where the minimum penetration length HA was "0". The evaluation standard of this test is as follows.

Evaluation Result A: the improvement rate of the attenuation is equal to or more than 3%, Evaluation Result B: the improvement rate of the attenuation is less than 3%, and Evaluation Result C: Reference level Respective evaluation results of the radio-wave noise reduction performance of Samples #9 to #16 are as shown in FIG. 6(B) and FIG. 7. That is, as shown in FIG. 6(B), it was confirmed that the radio-wave noise reduction performance tended to improve when the minimum penetration length HA became larger. Additionally, as shown in FIG. 7, it was confirmed that the radio-wave noise reduction performance tended to improve over the entire range of the test frequency of 50 to 900 MHz when the minimum penetration length HA became larger. This is considered to be because the effective length EL of the resistor 70 is lengthened since the rear-endmost position among the contact points (such as the point PP1 and the point PP2 in FIG. 2) between the inner peripheral surface of the through hole 12 and the tip end face 71 is more toward the tip end side as the minimum penetration length HA becomes larger.

A-3-3. Load Life Test of Resistor:

A load life test of the resistor 70 was carried out using Samples #9 to #16. The load life test was carried out based on test conditions compliant with Japanese Industrial Standard B8031: 2006 (internal combustion engine-spark plug) section 7.14. However, a condition more severe than the stipulation of Japanese Industrial Standard was adopted by heating to 400 degrees Celsius instead of the normal temperature. The load life (durability) was evaluated using a changing rate of the resistance value between the metal terminal nut 40 and the center electrode 20 before and after the test. The evaluation standard of this test is as follows.

Evaluation Result A: the changing rate is equal to or less than ±15%, Evaluation Result B: the changing rate is equal to or less than ±25%, Evaluation Result C: the changing rate is equal to or less than ±30%, and Evaluation Result D: the changing rate is equal to or more than ±30.

As shown in FIG. 6(B), in respective evaluation result of the impact resistance of Samples #9 to #16, it was confirmed that the durability tended to improve when the minimum penetration length HA became smaller. Furthermore, the durability was found to be considerably improved in the case where the minimum penetration length HA is equal to or less than 1.2 mm compared with 1.3 mm (or more). That is, it was found that the penetration length H was preferred to be set equal to or less than 1.2 mm.

Figure 8:
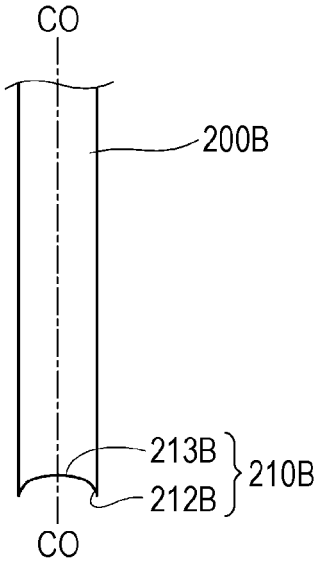
FIG. 8 is a diagram showing a compression rod member used in manufacture of the insulator assembly in a modification.

B. Modification:

(1) FIG. 8 is a diagram showing a compression rod member 200B used in manufacture of the insulator assembly in a modification. A tip end face 210B of the compression rod member 200B shown in FIG. 8 is molded in a shape approximated by the shape of the tip end face 71 of the resistor 70 in the insulator assembly to be manufactured, unlike the tip end face of the compression rod member 200 (in FIG. 4(A)) in the embodiment. The shape of the tip end face 71 changes from the shape before compression and sintering when the raw material powders 65, 75, and 85 are compressed and sintered. Therefore, the shape of the tip end face 71 might not conform to the shape of the tip end face 210B of the compression rod member 200B. However, in the case where the shape of the tip end face 210B is molded in the shape approximated by the shape of the tip end face 71 of the resistor 70 in the insulator assembly to be manufactured, this facilitates molding the shape of the tip end face 71 in any desired shape.

The example shown in FIG. 8 is an example of the compression rod member 200B to realize the shape (in FIG. 2) of the tip end face 71 described in the embodiment. That is, in the shape of the tip end face 210B of the compression rod member 200B, a peripheral edge portion 212B positioned at the radially outside of a center portion 213B is positioned at the tip end side compared with the center portion 213B close to the central axis CO, similarly to the shape of the tip end face 71 (in FIG. 2).

Figure 9:
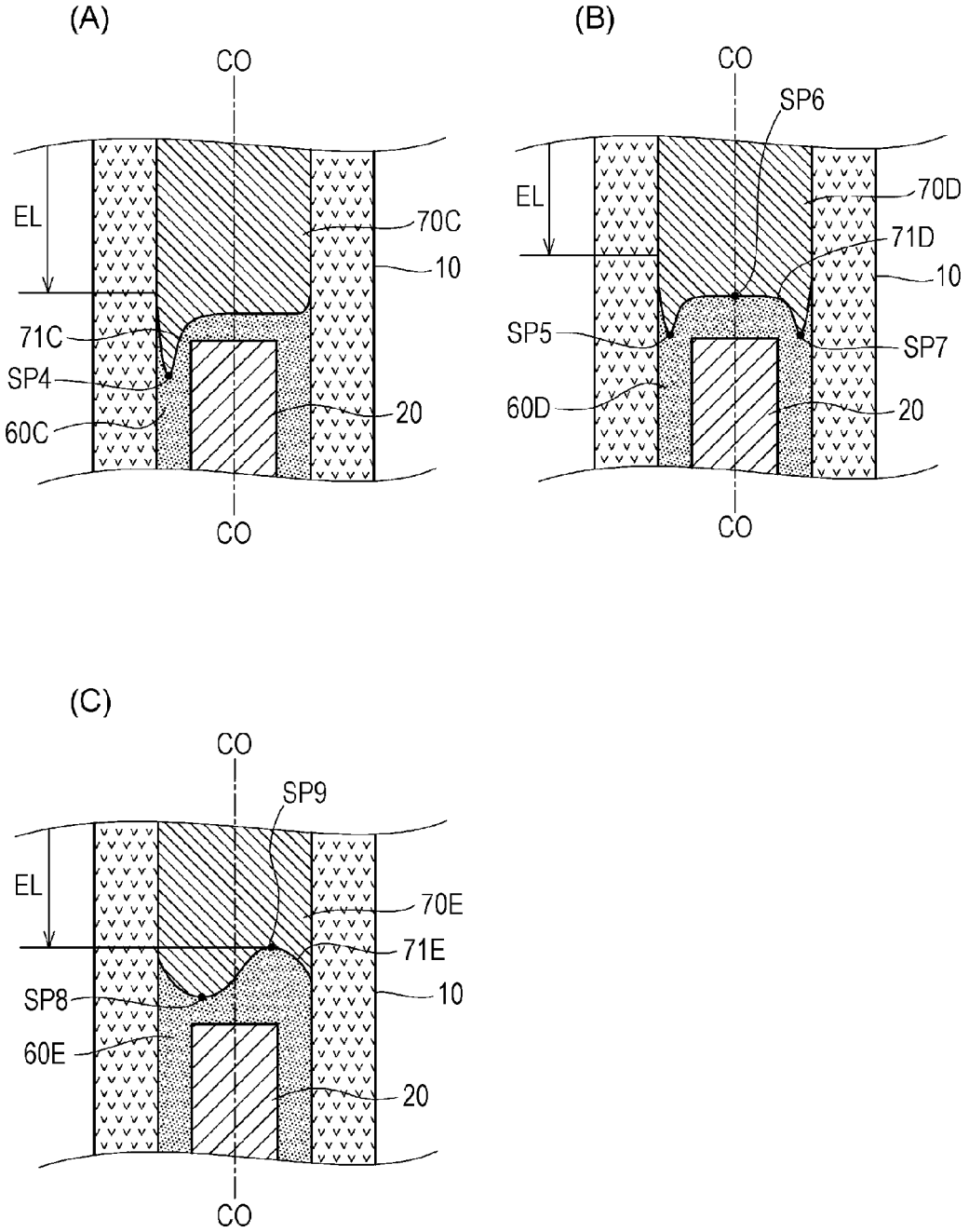
FIGS. 9(A) to 9(C) are diagrams showing an exemplary shape of a tip end face of the resistor in the modification.

(2) FIGS. 9(A) to 9(C) are diagrams showing an exemplary shape of the tip end face of the resistor in the modification. As shown in FIG. 9(A), a tip end face 71C of a resistor 70C does not necessarily have a plurality of local maximum points or local minimum points in the cross section including the central axis CO, and may have a configuration with only one of the local maximum point and the local minimum point (the total number of the local maximum point and the local minimum point indicates the total number of the local maximum point and the local minimum point formed in positions apart from the inner surface of the through hole of the insulator (the through hole 12 of the ceramic insulator 10). In the example shown in FIG. 9(A), the peripheral edge portion of the resistor 70C does not project toward the tip end side with respect to the center portion of the resistor 70C over the whole circumference, but only a part of the peripheral edge portion of the resistor 70C projects toward the tip end side with respect to the center portion of the resistor 70C.

However, in the case where the configuration has only one local maximum point or local minimum point, the tip end of the resistor 70C is preferred to be positioned at the tip end side with respect to the rear end of the head 23. In this case, the resistor 70C includes the portion positioned at the tip end side with respect to the rear end of the head 23. This expands the area of the tip end face 71C of the resistor 70C without shortening the effective length EL in the given portion. As a result, this reduces sealing failure between the conductive seal and the resistor without shortening the radio-wave noise reduction performance.

(3) As shown in FIGS. 9(B) and 9(C), tip end faces 71D and 71E of resistors 70D and 70E do not necessarily include a portion positioned at the tip end side with respect to the rear end of the center electrode 20. However, in the case where the tip end faces 71D and 71E do not include a portion positioned at the tip end side with respect to the rear end of the center electrode 20, the contact surface between the resistor and the conductive seal includes a portion where the distance in the central axis direction between the contact surface and the virtual plane (the virtual plane vertical to the central axis) including the rear end of the resistor changes according to the position along the contact surface. Furthermore, at least one cross section among a plurality of cross sections including the central axis CO (a plurality of cross sections with mutually different directions perpendicular to the cross sections) is preferred to have a plurality of points (referred to also as extremal points) where the distance from the rear end of the resistor in the central axis direction becomes local maximum or local minimum (especially, preferred to include one or more points (referred to also as the local maximum point) where the distance becomes local maximum and include one or more points (referred to also as the local minimum point) where the distance becomes local minimum). Here, the number of extremal points (the number of local maximum points and the number of local minimum points) indicates the number of extremal points (the number of local maximum points and the number of local minimum points) formed in positions apart from the inner surface of the through hole of the insulator (the through hole 12 of the ceramic insulator 10). The tip end face 71D of the resistor 70D in FIG. 9(B) is an example including three extremal points (two local maximum points SP5 and SP7 and one local minimum point SP6). The tip end face 71E of the resistor 70E in FIG. 9(C) is an example including two extremal points (one local maximum point SP8 and one local minimum point SP9). In this case, the tip end faces 71D and 71E of the resistors 70D and 70E do not include the portion positioned at the tip end side with respect to the rear end of the center electrode 20, but include the plurality of extremal points. This expands the respective areas of the tip end faces 71D and 71E without excessively shortening the effective length EL.

(4) The configuration of the spark plug is not limited to the configuration shown in the above-described embodiments and modifications. Various configurations may be adopted. For example, the shape of the rear end portion of the center electrode 20 (in FIG. 2) is not limited to the shape including the flange portion 24 and the head 23. Various shapes may be adopted. For example, the outer diameter of the head 23 may be the same as the outer diameter of the flange portion 24 (that is, the outer diameter may be uniform without change on the rear end side with respect to the shoulder portion 24*f*). In either case, the resistor 70 is preferred to include a portion positioned at the tip end side with respect to the rear end of the center electrode over the whole circumference of the side surface in the rear end portion including the rear end of the center electrode. This further expands the area of the contact portion between the resistor and the conductive seal without shortening the effective length of the resistor.

The inner diameter of the large inner diameter portion BRP in the through hole 12 of the ceramic insulator 10 (in FIG. 1) may be changed in accordance with the position along the direction parallel to the central axis CO (for example, a portion with an inner diameter expanding from the tip end side toward the rear end side may be disposed). Similarly, the inner diameter of the small inner diameter portion SRP may be changed in accordance with the position along the direction parallel to the central axis CO (for example, a portion with an inner diameter expanding from the tip end side toward the rear end side may be disposed). In either case, the large inner diameter portion BRP and the small inner diameter portion SRP are preferred to be constituted so that the inner diameter of the large inner diameter portion BRP becomes larger than the inner diameter of the small inner diameter portion SRP. Thus, the insulator shoulder portion 16 disposed between the large inner diameter portion BRP and the small inner diameter portion SRP is preferred to support the shoulder portion 24*f* of the center electrode.

(5) The sizes of the respective areas in the spark plug 100 described in the above-described embodiment are examples. This should not be construed in a limiting sense. As described above, the present invention is more ideally suited to the compact spark plug, but may be applied to a spark plug with a typical diameter or a large diameter. For example, the present invention may be applied to a spark plug where a diameter of the mounting screw portion 52 is 13 mm to 18 mm and a distance between opposite sides of the tool engagement portion 51 is 15 mm to 20 mm.

The embodiment and the modifications of the present invention are described above. However, the present invention is not limited to these embodiment and modifications. The present invention may be practiced in various forms without departing from its spirit and scope.

REFERENCE LIST

10 ceramic insulator
12 through hole
13 insulator leg portion
15 shoulder portion
16 shoulder portion
17 tip-end-side trunk portion
18 rear-end-side trunk portion
19 flange portion
20 center electrode
21 electrode base material
22 core material
23 head
24 flange portion
25 leg
28 electrode tip
30 ground electrode
31 base-material tip end portion
32 base-material base end portion
38 electrode tip
40 metal terminal nut
41 plug cap installation portion
42 flange portion
43 leg
50 metal shell
51 tool engagement portion
52 mounting screw portion
53 caulking portion
54 seal portion
56 shoulder portion
56 metal-shell-side shoulder portion
58 compression deformation portion
59 insertion hole
60 conductive seal
70 resistor
80 conductive seal
100 spark plug
200 compression rod member Having described the invention, the following is claimed:

1. A spark plug, comprising:

an insulator that extends along a central axis, the insulator including a through hole that passes through the insulator along the central axis;

a center electrode that extends along the central axis, the center electrode including a rear end positioned inside of the through hole;

a metal terminal nut that extends along the central axis, the metal terminal nut including a tip end positioned at the rear end side with respect to the rear end of the center electrode inside of the through hole;

a resistor disposed in a position between the center electrode and the metal terminal nut inside of the through hole and apart from the center electrode; and a conductive seal disposed between the resistor and the center electrode inside of the through hole, the conductive seal contacting both the center electrode and the resistor, wherein the resistor has a contact surface in contact with the conductive seal, the contact surface including:

a portion where a distance in the central axis direction between the contact surface and a virtual plane changes according to a position on the contact surface, the virtual plane including a rear end of the resistor and being vertical to the central axis; and only one point where the distance is local maximum and only one point where the distance is local minimum, in at least one cross section including the central axis.

2. The spark plug according to claim 1, wherein at least a part of the resistor is positioned at the tip end side with respect to the rear end of the center electrode.

3. A spark plug, comprising:

an insulator that extends along a central axis, the insulator including a through hole that passes through the insulator along the central axis;

a center electrode that extends along the central axis, the center electrode including a rear end positioned inside of the through hole;

a metal terminal nut that extends along the central axis, the metal terminal nut including a tip end positioned at the rear end side with respect to the rear end of the center electrode inside of the through hole;

a resistor disposed in a position between the center electrode and the metal terminal nut inside of the through hole and apart from the center electrode; and a conductive seal disposed between the resistor and the center electrode inside of the through hole, the conductive seal contacting both the center electrode and the resistor, wherein at least a part of the resistor is positioned at the tip end side with respect to the rear end of the center electrode.

4. The spark plug according to claim 2 or 3, wherein the resistor includes a portion positioned at the tip end side with respect to the rear end of the center electrode over a whole circumference of a side surface of a rear end portion including the rear end of the center electrode.

5. The spark plug according to claim 2 or 3, wherein a distance in the central axis direction between a tip end of the resistor and the rear end of the center electrode is equal to or less than 1.2 mm (millimeter).

6. The spark plug according to claim 1, wherein a distance in the central axis direction between the rear end of the center electrode and a tip end of the metal terminal nut is equal to or less than 13 mm (millimeter).

7. The spark plug according to claim 1, further comprising a metal shell that covers at least a partial range of an outer peripheral surface of the insulator in the central axis direction, wherein a rear end of the resistor is at the tip end side with respect to a rear end of the metal shell.

8. The spark plug according to claim 7, wherein the insulator includes: a large inner diameter portion; a small inner diameter portion positioned at the tip end side with respect to the large inner diameter portion, the small inner diameter portion having a smaller inner diameter of the through hole than an inner diameter of the large inner diameter portion; and an insulator shoulder portion that is a shoulder portion disposed between the large inner diameter portion and the small inner diameter portion, the center electrode includes an electrode shoulder portion that is a shoulder portion with an outer diameter expanding from the tip end side toward the rear end side, the electrode shoulder portion being a shoulder portion disposed at the tip end side with respect to the rear end of the center electrode and being supported by the insulator shoulder portion, a portion of the center electrode at the rear end side with respect to the electrode shoulder portion, the conductive seal, and the resistor are disposed inside of the through hole in the large inner diameter portion of the insulator, and a distance in the central axis direction between a tip end of the electrode shoulder portion and the rear end of the center electrode is equal to or more than 3.8 mm (millimeter).

9. The spark plug according to claim 1, wherein a minimum inner diameter of a portion where the resistor is disposed in the through hole of the insulator is equal to or less than 2.9 mm (millimeter).

* * * * *